US008584502B2

(12) United States Patent
Aichele et al.

(10) Patent No.: US 8,584,502 B2
(45) Date of Patent: Nov. 19, 2013

(54) FORMING DEVICE

(75) Inventors: Helmut Aichele, Goppingen (DE); Josef Schulz, Bad Ditzenbach (DE); Alexander Traxler, Winzingen (DE)

(73) Assignee: Hinterkopf GmbH, Eislingen/Fils (DE)

( * ) Notice: Subject to any disclaimer, the term of this patent is extended or adjusted under 35 U.S.C. 154(b) by 257 days.

(21) Appl. No.: 13/042,809

(22) Filed: Mar. 8, 2011

(65) Prior Publication Data

US 2011/0219842 A1 Sep. 15, 2011

(30) Foreign Application Priority Data

Mar. 10, 2010 (EP) ..... 10002466

(51) Int. Cl.
*B21J 11/00* (2006.01)

(52) U.S. Cl.
USPC ..... 72/405.09; 72/405.03

(58) Field of Classification Search
USPC ..... 72/94, 405.03, 405.09, 379.4, 715; 29/557, 38 A, 38 F, 38 C, 38 R, 48.5 R, 29/49, 48.5 A, 37 R, 33 J; 294/99.1, 119.3; 413/66–77; 248/311.2, 313, 316.2; 414/225.01–226.02
See application file for complete search history.

(56) References Cited

U.S. PATENT DOCUMENTS

| | | | | |
|---|---|---|---|---|
| 3,797,429 | A | 3/1974 | Wolfe | |
| 6,302,364 | B1 * | 10/2001 | Chiueh | 248/311.2 |
| 7,004,000 | B2 * | 2/2006 | Campo et al. | 72/94 |
| 2008/0069665 | A1 | 3/2008 | Hanafusa et al. | |

FOREIGN PATENT DOCUMENTS

| | | |
|---|---|---|
| EP | 0275369 | 7/1988 |
| WO | WO0158618 | 8/2001 |
| WO | WO2008077231 | 7/2008 |

* cited by examiner

*Primary Examiner* — Dana Ross
*Assistant Examiner* — Matthew G Katcoff
(74) *Attorney, Agent, or Firm* — Hoffmann & Baron LLP

(57) ABSTRACT

A forming device for cup-shaped hollow bodies (7) having a machine frame (2), a drive device (15), a workpiece rotary table (3) and having a tool holder (4) for accommodating processing tools (10), wherein the workpiece rotary table (3) and the tool holder (4) face one another and can be turned about a rotational axis (5) in relation to one another and can be linearly moved in relation to one another along the rotational axis (5), wherein the drive device (15) is designed for providing a rotary step movement and a cyclical linear movement between workpiece rotary table (3) and tool holder (4), in order to enable the hollow bodies (7) to be formed by means of the processing tools (10) in a plurality of consecutive processing steps, and wherein the workpiece holder (6) has a recess (16) for accommodating a hollow body (7) and a wall section (42), which limits the recess (16) in certain areas, has an adjustable geometry, which is designed to narrow the cross-section of the recess (16), in order to enable the hollow body (7) to be fixed on the workpiece holder (6).

16 Claims, 6 Drawing Sheets

FORMING DEVICE

BACKGROUND OF THE INVENTION

The invention relates to a forming device for cup-shaped hollow bodies having a machine frame, a drive device, a workpiece rotary table for accommodating workpiece holders, which are formed to fix hollow bodies, and having a tool holder for accommodating processing tools, wherein workpiece rotary table and tool holder face one another and can be turned about a rotational axis in relation to one another and can be linearly moved in relation to one another along the rotational axis, wherein the drive device is designed for providing a rotary step movement and a cyclical linear movement between workpiece rotary table and tool holder, in order to enable the hollow bodies to be formed by means of the processing tools in a plurality of consecutive processing steps, and wherein the workpiece holder has a recess for accommodating a hollow body and a wall section, which limits the recess in certain areas, has an adjustable geometry, which is designed to narrow the cross-section of the recess, in order to enable the hollow body to be fixed on the workpiece holder.

A forming machine is known from EP 0 275 369 A2, with which cup-shaped hollow bodies made of metal, in particular aluminium, can be formed in certain areas, in particular drawn in locally, from an essentially cylinder sleeve shaped initial state, so that, for example, a closing cap or an atomizer valve can be fitted in a sealing manner in the area of the opening. The known forming machine has a machine frame, on which a supporting tube is formed. A workpiece rotary table is pivot-mounted on an outer surface of the supporting tube. A linearly movable guide tube is accommodated in a recess bounded by the supporting tube, to the end section of which linearly movable guide tube the workpiece rotary table is attached. A drive device is accommodated in the machine frame, which drive device is designed to produce an intermittent rotary movement of the workpiece rotary table and to produce an oscillating linear movement of the guide tube and the workpiece rotary table connected to it. By means of the linear movement, the tools provided on the workpiece rotary table, in particular forming tools, can be brought into engagement with the hollow bodies held on the workpiece rotary table, in order to locally process them, particularly in order to plastically deform them. By means of the intermittent rotary movement of the workpiece rotary table, the hollow bodies can be brought into contact with the tools, attached to the tool holder table, in serial order so as to form the hollow bodies step by step from a starting geometry to a target geometry. Before carrying out the processing the hollow bodies are fixed by means of workpiece holders attached to the workpiece rotary table, and after carrying out the processing they are released again. For this purpose the workpiece holder has a piston which can be pneumatically actuated and which acts on a circumferential, flexible ring in an axial direction and can at least partly displace the ring inwardly in the radial direction, thereby clamping the hollow body at an outer surface and thereby fixing it to the workpiece holder.

SUMMARY OF THE INVENTION

The object of the invention consists in providing a forming device which enables reliable fixing of the hollow body to the workpiece holder, which can be at least temporarily released again, where applicable, during the forming process for the hollow body.

For a forming device of the kind mentioned at the outset, this object is achieved with the features of claim 1. In doing so, provision is made for the wall section with the adjustable geometry to be formed by a flexible membrane, which limits a fluid channel, formed in the workpiece holder, in certain areas. The flexible membrane is directly pressurised by the fluid pressure in the fluid channel, so that a conversion of the amount of energy, provided for the clamping of the hollow body, for example, in the form of kinetic energy used for an actuation, is converted into an amount of energy used for the clamping of the hollow body with a favourable efficiency factor. In doing so, the amount of energy required for fixing the hollow body can be kept at a low level. As a result actuators for providing the fluid pressure in the fluid channel can be dimensioned in a small and cost-effective way. Furthermore, due to the flexible membrane, which preferably has a much higher elasticity than the hollow body, usually formed with thin walls, the geometrical deviations in the outer contour of the hollow body can be favourably compensated. Local tension peaks, which can occur due to the compression of the flexible ring, as it is known from the state of the art, are almost completely omitted, because the pressure rates are the same throughout the fluid channel. Thereby a local overload of the hollow body during the clamping process can be avoided. Furthermore it is possible to allow a minor residual movability of the hollow body in relation to the workpiece holder with the respective design of the flexible membrane, of the fluid pressure intended for clamping and of the workpiece holder. This residual movability ensures that the reaction forces, which occur, for example, during forming processes on the hollow body and which are to be deflected into the workpiece holder, do not lead to local tension peaks. In fact, the hollow body can at least marginally give way when high reaction forces occur, in order to avoid tension peaks in the hollow body.

It is advantageous if a fluid displacement device is arranged in the fluid channel, preferably in a linearly moveable way, which fluid displacement device is formed for controlling a fluid pressure in the fluid channel in order to cause an alteration of shape of the flexible membrane. The fluid displacement device serves for the actuating energy, which is in particular conveyed externally to the workpiece holder, preferably in the form of a linear and/or rotatory actuation, to cause a pressure increase of the fluid, in particular a hydraulic fluid, carried in the fluid channel. The actuating energy can also be provided externally in the form of a magnetic field and/or electrical energy or it can be held in a storage device, for example an electric battery, in the workpiece holder in order to operate a respective fluid displacement device, for example a magnetically or electromagnetically controlled piston, a fluid pump, which can be operated magnetically and/or electrically, or a piezoelectric pump.

The fluid displacement device preferably has a rigid working piston, which is arranged in a linearly movable manner, or a flexible working membrane, which is clamped in a sealing manner on the edge-sides and is in particular formed as a rolling membrane. A working piston, which is linearly movable, is preferably used when high clamping forces are required for fixing the hollow body and therefore a high pressure in the fluid channel is required. A flexible working membrane enables a particularly cost-effective provision of a fluid displacement device. It is preferred for a displacement body to be assigned to the flexible working membrane, which displacement body is guided in a linearly movable manner and arranged outside the fluid channel filled with fluid, and is made, for example, of plastic. The displacement body ensures that the working membrane cannot move aside in an undesired manner when pressurising the fluid in the fluid channel, by which moving aside the pressure build-up onto the fluid would be at risk. In addition the displacement body can be formed in such a way, that the working membrane is always guided without bends and/or local tension peaks during pressure build-up in the fluid channel, in order to avoid a premature wear and tear of the working membrane. This applies in particular when the working membrane is formed as a rolling membrane, which enables a particularly compact design of the working membrane, and when using the rolling membrane, areas of the membrane, which are annularly shaped and connected to one another, glide past one another during pressure build-up or pressure reduction.

In a further embodiment of the invention, provision is made for a preloading means, preferably comprising a spring means, to be assigned to the fluid displacement device, to place the displacement device into a priority position, preferably into a pressure position. The preloading means ensures that the workpiece holder is in a defined priority position regarding the clamping of the hollow body to be picked up, without an external actuation or an external control signal. The defined priority position can, for example, be a position in which the fluid taken up in the fluid channel is without pressure, in particular shows no difference in pressure in relation to a surrounding atmosphere, and therefore the flexible membrane is not or only slightly distorted and therefore releases a maximum free cross-section in the recess of the workpiece holder. It is particularly advantageous if the priority position corresponds to a clamping position in which a hollow body is fixed in the workpiece holder. A considerable number of processing steps in the forming device require the hollow body to be fixed to the workpiece holder. Therefore it is advantageous if during these processing steps no provision of energy is required to ensure fixing of the hollow body. A provision of energy, in particular in the form of an actuation conveyed externally to the workpiece holder, is required if the hollow body must be partly or fully released from the workpiece holder. This is achieved by arranging the preloading means, which can be, for example, a spring means, in particular a pressure spring or a cup-spring arrangement, on the workpiece holder in such a way, that they push the fluid displacement device into a position, in which there is enough pressure in the fluid channel for fixing the hollow body and the flexible membrane is deviated in such a way that it can apply enough clamping force, preferably directed radially inwards, onto the hollow body. In order to release the hollow body it is accordingly required that an amount of energy is conveyed to the preloading means, which amount of energy is sufficient to bring the preloading means from an essentially unloaded priority position into a loaded functional position. Thereby the pressurisation in the fluid channel is at least partly, preferably completely, neutralised and the hollow body is released.

The fluid displacement device preferably comprises a pivot-mounted operating lever which is formed for coupling a working tappet, which is functionally connected to the working piston or the working membrane, to the preloading means and/or for triggering an outer actuation onto the working tappet. The operating lever enables a compact arrangement of the preloading means on the workpiece holder, as it is not necessary to arrange the preloading means in the proximate vicinity of the fluid displacement device. Additionally or alternatively the operating lever can be designed to convey an actuation, which is conveyed externally to the workpiece holder and in particular serves to release the hollow body, to the fluid displacement device and preferably at the same time to the preloading means. The fluid displacement device comprises a working tappet, which preferably protrudes beyond an outer contour of the workpiece holder and is mounted in a linearly movable manner, which working tappet is formed for the power transmission between operating lever and working piston or working membrane. Amongst other things the working tappet has the function of converting the pivoting movements of the pivot-mounted operating lever into a linear movement for the working piston or the working membrane.

In one embodiment of the forming device provision is made for the flexible membrane to be formed annularly. As a result the hollow body can be clamped over an area of its outer surface, which area is annular and rotation symmetrical to its longitudinal axis, so that a reliable power transmission between hollow body, membrane and workpiece holder can always be ensured, irrespective of processing forces, which might act upon the hollow body in an asymmetrical manner. Preferably the membrane is formed annularly since the hollow bodies to be processed are formed rotation symmetrically at least in the clamping area, in which the membrane abuts on the outer surface of the hollow body. In one embodiment of the invention the membrane is toroidal in shape and has at least one connecting piece, which preferably protrudes outwardly in a radial direction, for a communicating fluid connection to the fluid channel formed in the workpiece holder.

It is advantageous if flexible membrane has a U-shaped cross-section, which is open outwardly in the radial direction, in a cross-sectional plane, which comprises a longitudinal axis of the recess. As a result a cost-effective manufacturing of the membrane can be achieved. The membrane can, for example, be formed as an injection-moulded part made of plastic.

Preferably the flexible membrane is formed in such a way that an interior surface area of the flexible membrane, which interior surface area limits the recess in certain areas, carries out a movement upon pressurisation of the fluid channel, which movement comprises a movement component which is directed radially inwardly and a movement component, which is directed parallel to the longitudinal axis of the recess, in particular in the opposite direction of the mouth opening. As a result not only the fixing of the hollow body, which is caused by the movement of the membrane in a radial inward direction, but also an axial displacement of the hollow body during the clamping process is enabled, without requiring any additional devices. Due to the axial displacement of the hollow body, which preferably pushes the hollow body towards the bottom of the recess of the workpiece holder, it is possible for the hollow body to abut on the abutment face provided in the bottom area of the recess. This is advantageous for a correct abutment of the hollow body on the workpiece holder and alignment with respect to the workpiece holder, which has an advantageous effect on the processing quality of the forming processes to be carried out on the hollow body.

In a further embodiment of the invention provision is made for the flexible membrane to be formed in such a way that the two movement components which are aligned perpendicularly to one another are at least nearly commensurate.

Preferably at least one leg of the U-shaped cross-section of the flexible membrane encloses an acute angle with the longitudinal axis of the recess, preferably an angle less than 80 degrees, particularly preferably an angle less than 70 degrees, in particular an angle less than 60 degrees. By choosing the angle it is possible to determine the movement component for the flexible membrane when carrying out a clamping process. The smaller the enclosed angle is chosen, the bigger is the movement component along the longitudinal axis of the recess.

It is advantageous if both legs of the U-shaped cross-section of the flexible membrane are aligned at least nearly parallel to one another. As a result the flexible membrane can abut as uniformly and continuously as possible on the outer surface of the hollow body.

In a further embodiment of the invention provision is made for at least one leg of the U-shaped cross-section of the flexible membrane to have a circumferential bead in a radially exterior circumferential area, which circumferential bead is formed to be fixed in a sealing manner in the workpiece holder. By means of the at least one circumferential bead the radially exterior circumferential area of the membrane can be accommodated on the workpiece holder in a form-fitting and, where applicable, additionally also in a force-fitting manner. By means of the form-fitting accommodation an advantageous power transmission between membrane and workpiece holder is ensured. The force-fitting fixing of the membrane brings about compression of the elastic, preferably rubbery-elastic, membrane material, as a result of which the sealing between membrane and the fluid channel formed in the workpiece holder is promoted.

Preferably a cone ring is arranged between the flexible membrane and a mouth opening of the recess, the conical interior surface of which cone ring limits the recess in certain areas and tapers as its distance from the mouth opening increases. The task of the cone ring is to achieve a centering of the hollow body when the hollow body is being inserted into the recess of the workpiece holder. Additionally the cone ring also serves for the protection of the flexible membrane, which although it is at least nearly completely unloaded during the insertion of the hollow body and therefore releases a maximum cross-section of the recess, could nevertheless be damaged by a defective hollow body and/or by insertion of the hollow body at an angle. Preferably a minimum interior diameter of the cone ring is chosen slightly bigger than a maximum diameter of the membrane in an unloaded condition, so that a contact with the membrane is avoided when inserting the hollow body.

It is advantageous if the flexible membrane is formed in an annular area for a touch contact with the hollow body, which area has a width of less than 20 mm, preferably less than 15 mm, particularly preferably less than 10 mm, in particular less than 5 mm, and which area is at a distance of less than 20 mm, preferably less than 15 mm, particularly preferably less than 10 mm, in particular less than 5 mm from a bottom plane of the hollow body, which bottom plane is determined by the recess. Given a small width of the annular contact area and a small distance of the contact area to the bottom plane of a hollow body accommodated in the workpiece holder, it can be ensured that the hollow body can be processed, in particular formed, nearly across its entire length and almost down to the bottom plane. It is preferred to provide a touch contact in an area of the hollow body, which is at a distance to the bottom area of less than 10 mm and in which the annular contact area has a width of less than 10 mm. It is particularly preferred for the bottom area boundary of the contact area to be at a distance from the bottom plane of less than 5 mm and for an upper area boundary of the contact area to be at a distance from the bottom plane of less than 9 mm, preferably less than 8 mm. An advantageous width of the annular contact area therefore is in particular 5 mm or less.

In a further embodiment of the invention it is provided for a first actuating means for triggering a locking movement onto the respective workpiece holder to be assigned to the workpiece rotary table at a locking position, and/or for a second actuating means for triggering an unlocking movement to be assigned to the workpiece rotary table at an unlocking position, and for a third actuating means for triggering an actuation for the at least partial unlocking and subsequent locking of the hollow body during a cycle of the cyclical linear movement to the respective workpiece holder to be assigned to the workpiece rotary table at a processing position. The first actuating means enables a locking of the hollow body on the workpiece holder and is in particular arranged at a loading position for the workpiece rotary table. At the loading position, the hollow bodies are conveyed to the workpiece holder by an upstream conveying device, for example a conveyor belt, by means of an interconnected conveyor, for example a low-pressurised loading star. The second actuating means is arranged at an unlocking position, at which the workpiece holder releases the processed hollow body for further conveyance through a downstream conveying device, for example a conveyor belt. The third actuation means serves for initially at least partly releasing the hollow body during a cycle of the cyclical linear movement, in particular during a time fraction of the cyclical linear movement, and then locking it again. In the time slot between at least partial unlocking and locking again the hollow body can, for example, be moved, in particular with respect to the workpiece holder.

BRIEF DESCRIPTION OF THE DRAWINGS

An advantageous embodiment of the invention is shown in the drawing, in which the following is shown.

DETAILED DESCRIPTION OF THE PREFERRED EMBODIMENTS

Figure 1:
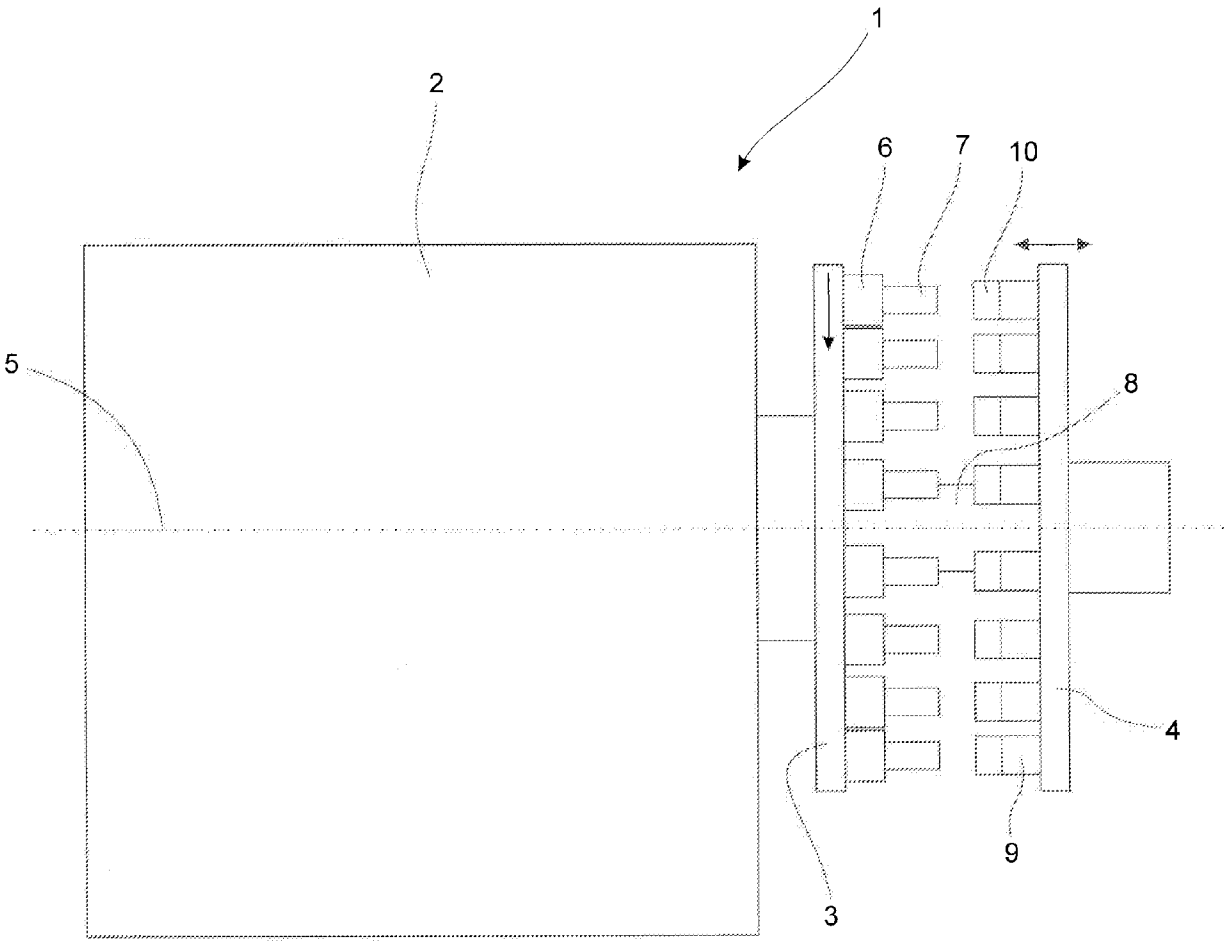
FIG. 1 a schematic side view of a forming device.

A forming device 1 illustrated in FIG. 1 is designed for the processing of hollow bodies, in particular aluminium cans, using a stepwise forming method. The forming device 1 comprises a machine frame 2, to which by way of example a workpiece rotary table 3 is pivotably mounted and a tool carrier 4 is mounted in a linear movable manner, as is indicated by the respective arrows in FIG. 1.

The workpiece rotary table 3 is movable in a stepwise rotary movement, also called rotary step movement, about a rotational axis 5 by means of a drive device, not shown in detail in FIG. 1. Preferably the drive device and the workpiece rotary table 3 are coordinated with one another in such a way that the rotary step movement always occurs with the same step size, in particular with the same angle, about the rotational axis 5. A plurality of workpiece holders 6 are arranged on the workpiece rotary table 3, preferably at the same division of an angle about the rotational axis 5, which workpiece holders 6 are arranged for accommodating hollow bodies 7.

The drive device, not shown in FIG. 1, which is accommodated in the machine frame 2, is also designed for providing a cyclical linear movement to the tool carrier 4. The tool carrier 4 is mounted on a supporting tube 8 in a linearly movable manner and can carry out an oscillating stroke movement with respect to the workpiece rotary table 3. A plurality of tool holders 9 are arranged on the tool carrier 4, which tool holders 9 are arranged on the workpiece rotary table 3 at the same division of an angle about the rotational axis 5 as the workpiece holders 6 and which tool holders 9 are provided for accommodating processing tools 10, in particular forming tools or cutting tools, such as milling cutters. By means of the processing tools 10 forming operations or other processing operations can be carried out, within the scope of the cyclical linear movement of the tool holder, on the hollow bodies accommodated in the workpiece holders 6.

In each working position of the workpiece rotary table 3, which results after carrying out a rotary step movement, the workpiece holders 6 are arranged opposite the tool holders 9 and can carry out the desired processing of the hollow bodies within the scope of the cyclical linear movement.

Figure 2:
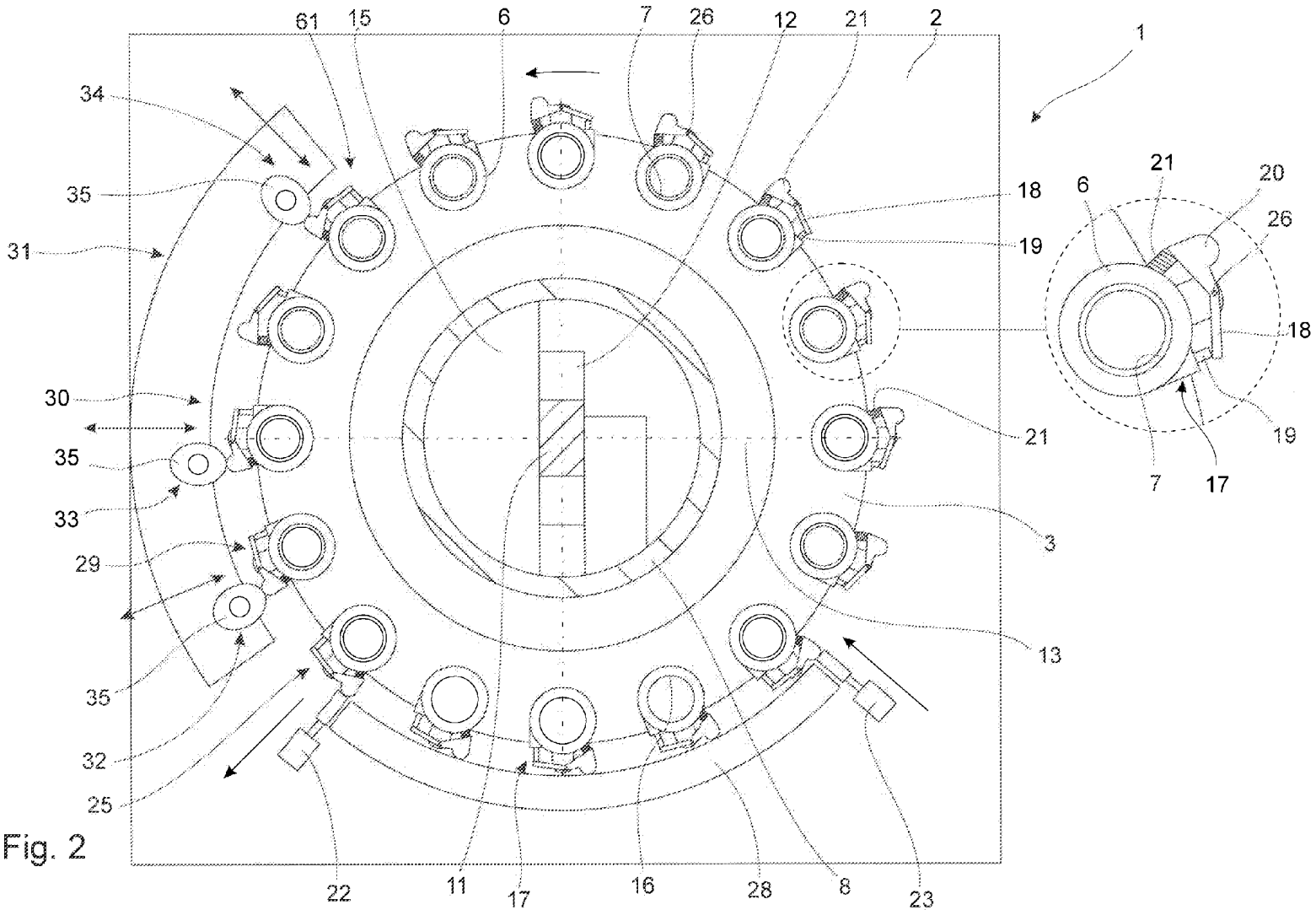
FIG. 2 a partly cut front view of the forming device according to FIG. 1, FIG. 3 a perspective illustration of a workpiece holder, FIG. 4 a partly cut front view of the workpiece holder, FIG. 5 a cross-sectional view of the workpiece holder and FIG. 6 a temporal flow chart for carrying out a processing method using the forming device.

The arrangement of the work piece holders 6 at a constant division of an angle about the rotational axis 5, running perpendicular to the representation plane, can be seen in the schematic illustration of FIG. 2. The direction of the rotary step movement for the workpiece rotary table is by way of example indicated anti-clockwise. Each of the workpiece holders 6 takes up a fixed working position in a time interval between two rotary step movements, in which working position an interaction with the processing tools 10, which are accommodated on the tool carrier 4 (not shown) and are not illustrated, is provided.

The supporting tube 8, on which the tool holder is guided in a linearly movable manner, is shown in cut illustration in FIG. 2. A coupling slide (not illustrated in detail) is guided in the supporting tube 8, which coupling slide can be linearly displaced along a movement axis, which is aligned perpendicularly to the representation plane in FIG. 2. The coupling slide is coupled to a connecting rod 11. The connecting rod 11 is coupled to a double eccentric arrangement 12, which can be rotated about a rotational axis 13 by a drive device 15, in order to generate a combined rotational and translational movement from a purely rotational movement, which is conveyed to the connecting rod 11. The connecting rod 11 moves the coupling slide in a cyclical linear movement which is conveyed to the tool carrier 4.

Each of the workpiece holders 6 comprises an integrated clamping device 17, which is arranged to confine a recess 16, for example cylindrically designed, at least in certain areas in the radial direction in the workpiece holder 6 and thereby to provide the clamping force required for clamping the hollow body 7.

An operating lever 18 is by way of example assigned to each workpiece holder 6 for controlling the clamping device 17, which operating lever 18 is pivot-mounted on the workpiece holder 6 by means of a joint bearing 26 and is provided for controlling a control pin 19 provided by way of example. The control pin 19 belongs to the clamping device 17 and can, for example, act on a fluid piston (not shown) of the clamping device 17, which fluid piston is provided, for example, for the pressurisation of a fluid, in particular a hydraulic fluid, contained in the clamping device 17. By way of example it can be provided for the clamping device 17 to comprise an annular, elastic membrane, which is arranged circumferentially in the recess 16 and will be described in more detail below. This membrane can be designed in such a way that it curves inwardly in a radial direction when the fluid in the clamping device 17 is pressurised and thereby causes the desired restriction of the cross-section of the recess 16 in order to clamp the hollow body 7.

The operating lever 18 has by way of example a cam extension 20 on an area pointing away from the workpiece holder 6, which cam extension 20 is provided for abutting on control elements described in more detail below. A spring device 21 is arranged between an end area of the operating lever 18, facing away from the control pin, and the workpiece holder 6, which spring device 21 can be formed, for example, as a pressure spring, in particular as a coiled spring or a cup-spring stack. The spring device 21, for example, applies a pressure force to the assigned end area of the operating lever 18. By way of example the pressure force is calculated in such a way that the clamping device 17 is brought into a loaded priority position without any outside influences. This ensures that the clamping device 17 reliably fixes the hollow body 7 in the workpiece holder 6, without any outside influence on the workpiece holder 6, in particular on the operating lever 18.

In order to unlock the hollow body 7 from the workpiece holder 6, an actuation, which is at least nearly directed inwardly in a radial direction, is conveyed by way of example to the operating lever 18. This actuation can be conveyed to the operating lever 18 as a pure linear movement in a first embodiment of an actuating means. A fluidically or electrically driven linear actuator, in particular a fluid cylinder or an electrical linear direct drive can for example be used for this purpose. By way of example the first actuating means 22 and the second actuating means 23 are both designed as linear actuators in the embodiment of FIG. 2. A control rail 28 is arranged between the second actuating means 23, which are assigned to an unloading position 24 of the workpiece rotary table 3, and the first actuating means 22, which are assigned to a loading position 25 of the workpiece rotary table 3. The control rail 28 is formed in such a way that it acts on the cam extension 20 of the operating lever 18 and forces the operating lever 18 into a operating position along a circular movement path of the workpiece holders 6 between the second actuating means 23 and the first actuating means 22, in which operating position the clamping devices 17 are at least nearly completely unloaded. In the present case the clamping device 17 is unloaded at the unloading position 24 by means of the second actuating means 23 by triggering the operating lever 18, as a result of which it is possible to take or slide the hollow body 7 out of the workpiece holder 6. The workpiece holder 6, arriving at the loading position 25 in the course of the rotary step movements with an unloaded clamping device 17, is initially held in the illustrated unloaded position by the first actuating means 22. Before conveying a further rotary step movement to the workpiece rotary table 3, a hollow body is inserted into the workpiece holder 6 to begin with. Then the first actuating means 22 releases the operating lever 18 in such a way that it can return to its priority position corresponding to the preloading of the spring device 21, in which priority position the clamping device 17 is loaded and the hollow body 7 is fixed to the workpiece holder 6.

By way of example an at least partly unlocking and subsequently a re-locking of the hollow body 7 in the workpiece holder 6 occurs at the first processing position 29, which is arranged in the one angle step of the rotary step movement offset with respect to the loading position 25. For this purpose an actuating module 31 is arranged adjacent to the workpiece rotary table 3, which is connected to the machine frame 2 in a stationary manner. The actuating module 31, which is illustrated in more detail in FIGS. 3 to 5, comprises by way of example three further actuation means 32, 33, 34, which are in each case formed for conveying at least proportionately linear actuations to the operating levers 18 of the in each case periodically opposing workpiece holders 6. Each of the actuation means 32, 33, 34 has a pivot-mounted cam disc 35 which is pivot-mounted at the actuating module 31 and which can be put into a rotary movement by drive devices (not illustrated in detail).

Figure 3:
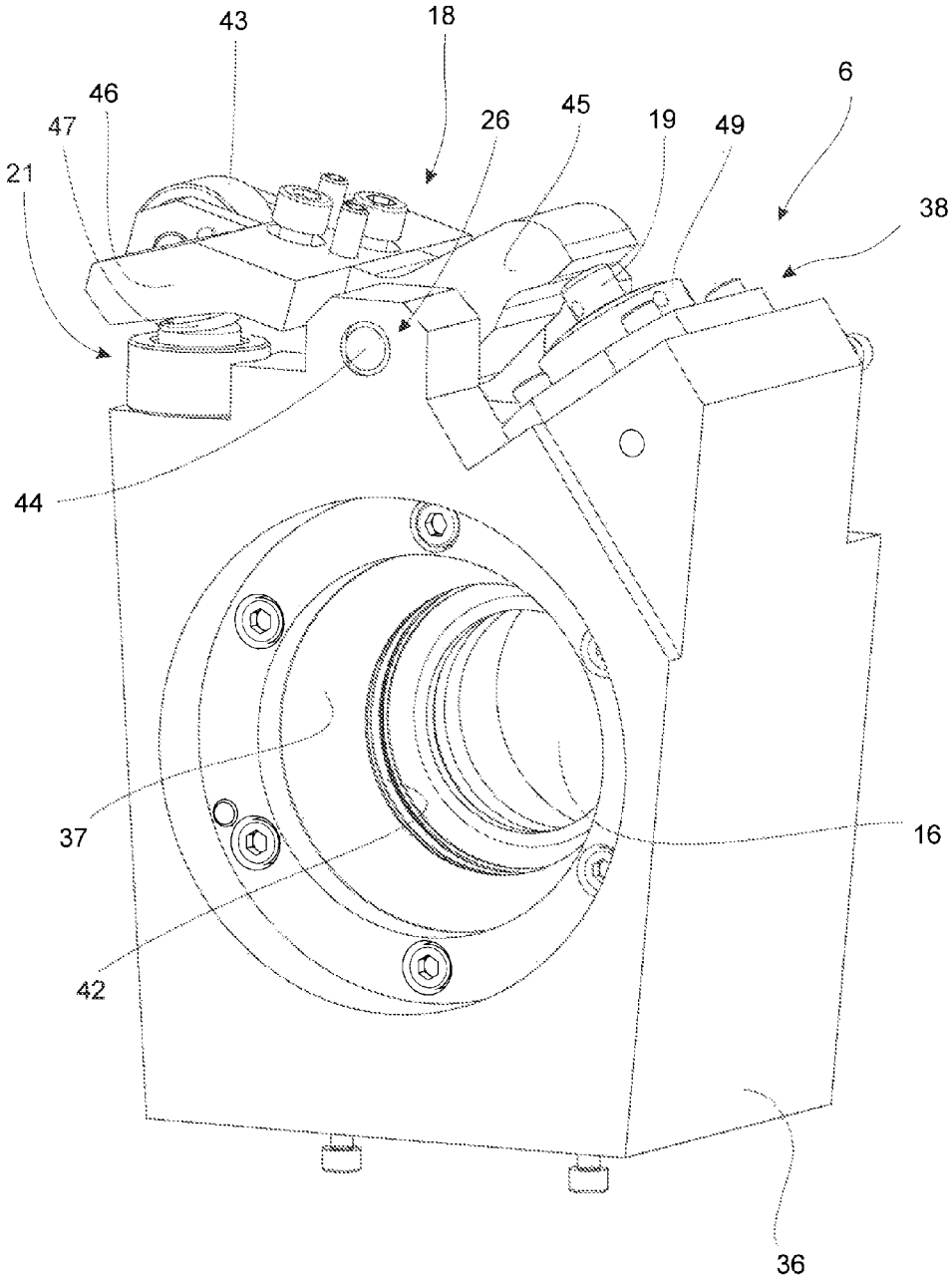
Figure 4:
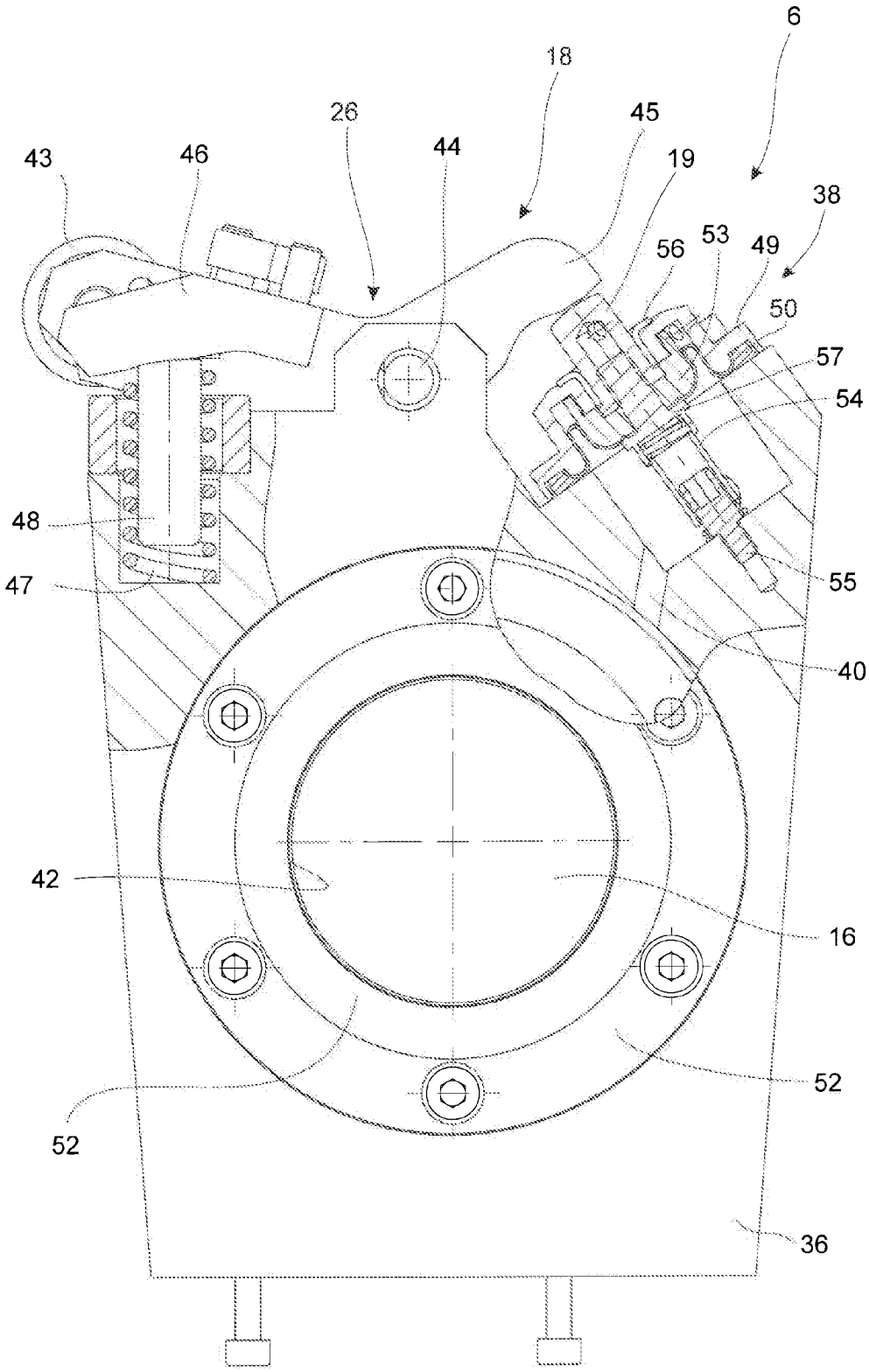
Figure 5:
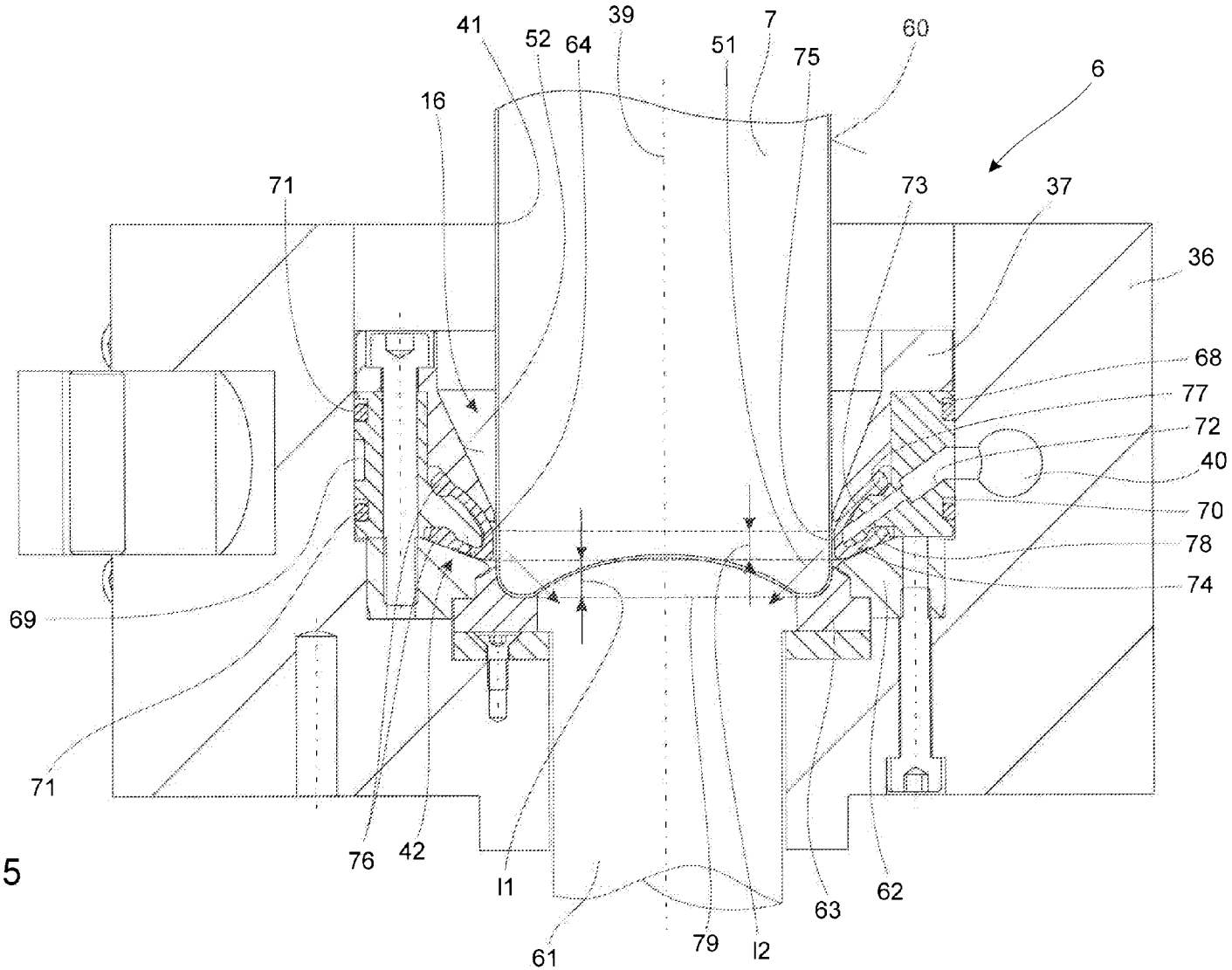

The workpiece holder 6 illustrated in FIGS. 3 to 5 forms an independent unit, which can be fixed locally in a precise manner to the workpiece rotary table 3 by mounting means (not illustrated in detail), in particular screw fittings, and positioning means, in particular alignment pins.

The workpiece holder 6 comprises a base body 36, preferably made of metal, on which the operating lever 18, the spring means 21 and a fluid displacement device 38, described in more detail below, are arranged. The operating lever 18 is pivot-mounted to the workpiece holder 6 by means of the joint bearing 26, which comprises a joint bolt 44, which is mounted in the base body 36 in a torque-proof manner. The operating lever 18 comprises a first lever section 45 and a second lever section 46, which extend in opposite directions to one another in each case starting from the joint bearing 26. The first lever section 45 rests on its end side on the control pin 19, which is assigned to the fluid displacement device 38. The second lever section 46 is formed in a forked manner on its end side and carries a pivot-mounted idling roll 43 between the fork legs.

The second lever section rests on a guide bolt 48 of the spring means 21 with a bottom side arranged opposite the base body 36. The guide bolt 48 is accommodated in a coil spring 47 and serves for transmission of the spring force of the coil spring 47, formed as a pressure spring by way of example, to the operating lever 18.

A cone ring 37 is arranged in the recess 16 of the workpiece holder 6, which cone ring 37 limits the recess in certain areas and which tapers conically in certain areas. An annularly circumferential flexible membrane 42 is arranged below an end area of the cone ring, which flexible membrane 42 limits a fluid channel 40, formed in the base body 36 and described in more detail below, in certain areas in a shape-changing way and is provided for a periodical and reversible restriction of the free cross-section of the recess 16, in order to clamp a hollow body 7.

The fluid displacement device 38 comprises a cap 49, which is mounted, by way of example screwed, to the base body 36, as can be seen in FIG. 4. The cap 49 serves as a linear guide for the control pin 19, which is coupled to a guide body 53, arranged below the cap 49. A sliding bush 56, fixed in the cap 49, is provided for the linear guiding of the control pin 19 which penetrates the cap 49.

The cap 49 also serves for fixing the rolling membrane 50, formed in a rotation-symmetrical manner, which is held on a radially external edge area between cap 49 and base body 36 in a sealing manner. The guide body 53 is connected to the control pin 19 by a retaining bolt 57, which is screwed into the control pin 19 by way of example, in such a way, that the rolling membrane 50 also seals off the fluid channel 40 and the fluid taken up therein in a radially inward lying area against the surrounding atmosphere.

The guide body 53 serves for supporting the rolling membrane 50 during a linear movement of the control pin 19 towards the working chamber 59 formed in the base body 36, and therefore to ensure that the rolling membrane 50 pressurises the fluid (not illustrated in detail) in the fluid channel 40, in particular in the working chamber 59.

The retaining bolt 56 has an annular guide collar 58 at an end section opposite the control pin 19, which guide collar 58 accommodates a first end section of a restoring spring 54. The second end section of the restoring spring 54 encompasses a guide tenon 55, which is screwed onto the base body 36 by way of example. The task of the restoring spring 54 is to bring the guide pin 19, the rolling membrane 50, the retaining bolt 57 and the guide body 53 into the position shown in FIG. 4 without any outside influences acting on the fluid displacement device 38, in which position there is at least nearly no pressurisation of the fluid and in which position no clamping forces are exerted on a hollow body 7.

In the present embodiment of the workpiece holder 6 the spring device 21 is arranged in such a way that a spring force is exerted constantly on the second lever section 46, as a result of which a pressure force is exerted on the control pin 19 of the fluid displacement device 38. Due to this pressure force, the rolling membrane 50, attached to the control pin 19, is moved by means of the guide body 53 from the position shown in FIG. 4 towards the working chamber 59, whereby pressurisation of the fluid occurs. Due to this pressurisation the membrane 42, illustrated in more detail in FIG. 5, is pressurised at an outer surface with the fluid pressure and is thereby expanded. When expanding, the membrane 42 performs a combined radial and axial movement. The radial component of the movement is hereby directed inwardly in a radial direction and can cause the membrane 42 to abut on an outer surface 60 of the hollow body 7. The axial component of the movement is oriented parallel to a longitudinal axis 39 of the hollow body 7 and the recess 16 and acts from the mouth 41 of the recess 16 towards a bottom forming tappet 61 accommodated in the recess 16. The direction of the expanding movement of the membrane 42 is indicated by the direction arrows 51. As a result the hollow body 7 is not only pressurised with a clamping force in the radial direction, but is also, at least to a certain degree, drawn into the workpiece holder 6 in the axial direction.

The bottom forming tappet 61 is provided for causing the concave impression at the bottom of the hollow body 7, when a pressure force is applied, directed from the opening of the hollow body 7 towards the bottom forming tappet 61. For this purpose the bottom forming tappet 61 is provided with a convex geometry on a surface facing the hollow body 7, which convex geometry can be impressed in the hollow body 7 during the forming process. In addition the bottom forming tappet 61 can be used to eject the hollow body 7 from the workpiece holder 6. For this purpose the bottom forming tappet 61 is moved towards the mouth 41 of the recess 16 in relation to the base body 36. The bottom forming tappet 61 together with a supporting ring 63, described in more detail below, determines the bottom plane 79 of the hollow body 7 which can also be denoted as the contact area of the hollow body 7.

In order to ensure a reliable abutment of the hollow body 7 on the workpiece holder 6, a supporting ring 63 is arranged in a circular manner about the bottom forming tappet 61, which supporting ring 63 has a circularly circumferential, concave recess in which the edge area of the hollow body 7 can be accommodated and supported. A pressure ring 62 rests on the supporting ring 63, which pressure ring 62 is formed conically on a surface 64 which is facing away from the supporting ring 63. The flexible membrane 42, formed with a U-shaped cross-section, is accommodated between a conical outer surface 65 of the cone ring 37 and a circumferential retaining ring 66, which extends inwardly at an angle towards the bottom forming tappet 61 and tapers blade-like by way of example. The membrane 42 limits a chamber assigned to the fluid channel 40 in a radial inward direction, which chamber is outwardly limited by the retaining ring 66 and which cannot be seen in FIG. 5 due to the absence of pressurisation of the fluid. When the chamber is pressurised, the membrane 42 rises up from the surface of the retaining ring 66, at least in certain areas, and expands inwardly in a radial direction and in an axial direction, downwardly according to the illustration in FIG. 5. Hereby the volume of the chamber corresponds to the volume of the fluid, which is displaced by the fluid displacement device 38 when a linear actuation is conveyed to the control pin 19 in the working chamber 59.

The retaining ring 66 is moulded onto a channel ring 67, which is essentially formed in a cylindrical manner and which is accommodated in a cylindrical section of the recess 16. The channel ring 67 comprises a plurality of circumferential grooves 68, 69, 70 on its outer circumference. Sealing rings 71 are accommodated in the grooves 68 and 70 respectively, which sealing rings 71 serve for sealing the third groove 69, serving as part of the fluid channel 40, against the atmosphere. Through the circumferential groove 69, inclined bores, inserted into the channel ring 66 and exiting at the outer surface of the membrane 62, are in communicating connection with the working chamber 59.

The membrane 42, formed with a U-shaped cross-section, has a first U-leg 73, a second U-leg 74 and a membrane ring 75, which connects both legs 73 and 74. Each of the two legs 73, 74 has a circumferential bead arranged radially outward at its respective end side, which circumferential bead is in each case provided for a form-fitting accommodation between the outer surface 65 of the cone ring 37 and the retaining ring 66 or between the retaining ring 66 and the conical surface 64 of the pressure ring 62. The two legs 73, 74 are oriented almost parallel to one another, the membrane ring 75 is formed almost cylindrically in the unloaded position of the membrane 42, wherein its rotation-symmetrical axis corresponds to the longitudinal axis 39.

Preferably the retaining ring 66 has respectively circumferential groove-like depressions 77, 78 in the areas near the channel ring 67, which depressions serve for accommodating the circumferential beads 76. The retaining ring 66, the cone ring 37 and the pressure ring 62 as well as the beads 76 of the membrane 42 are synchronised in such a way, that the membrane 42 is clamped in a form-fitting and force-fitting manner at the edges, as a result of which a secure and sealed fixing of the membrane 42 is ensured. Therefore the membrane 42 seals off the fluid channel 40 against the atmosphere, at least in certain areas, and thereby forms the wall section of the recess 16, which can be adjusted regarding its geometry.

In the illustrated embodiment of the workpiece holder 6 a gap denoted 11 between the bottom plane 79 and a lower area boundary of a contact area between membrane 42 and hollow body 7 is at a distance of less than 5 mm from the bottom plane. A gap denoted 12 between the lower area boundary of the contact area and its upper area boundary is also less than 5 mm. As a result the hollow body 7 is clamped within an annular area measured from the bottom plane 79, which annular area is approximately 4 mm wide and is at a distance from the bottom plane 79 of approximately 4 mm.

Preferably the retaining ring 66, the cone ring 37 and the pressure ring 62 together with the membrane 42, accommodated thereon, form a separate unit, which can be mounted and tested regarding the sealing irrespective of the base body 36. In a later mounting step this unit only needs to be provided with the sealing rings 71 and to be inserted into the recess 16 of the workpiece holder 6. Due to the circumferential groove 69 there is no need to orientate the unit in a rotatory manner with respect to the base body 36. The communicating connection between the fluid channel 40 and the inclined bores 72 rather results solely from inserting the unit into the recess 16.

Figure 6:
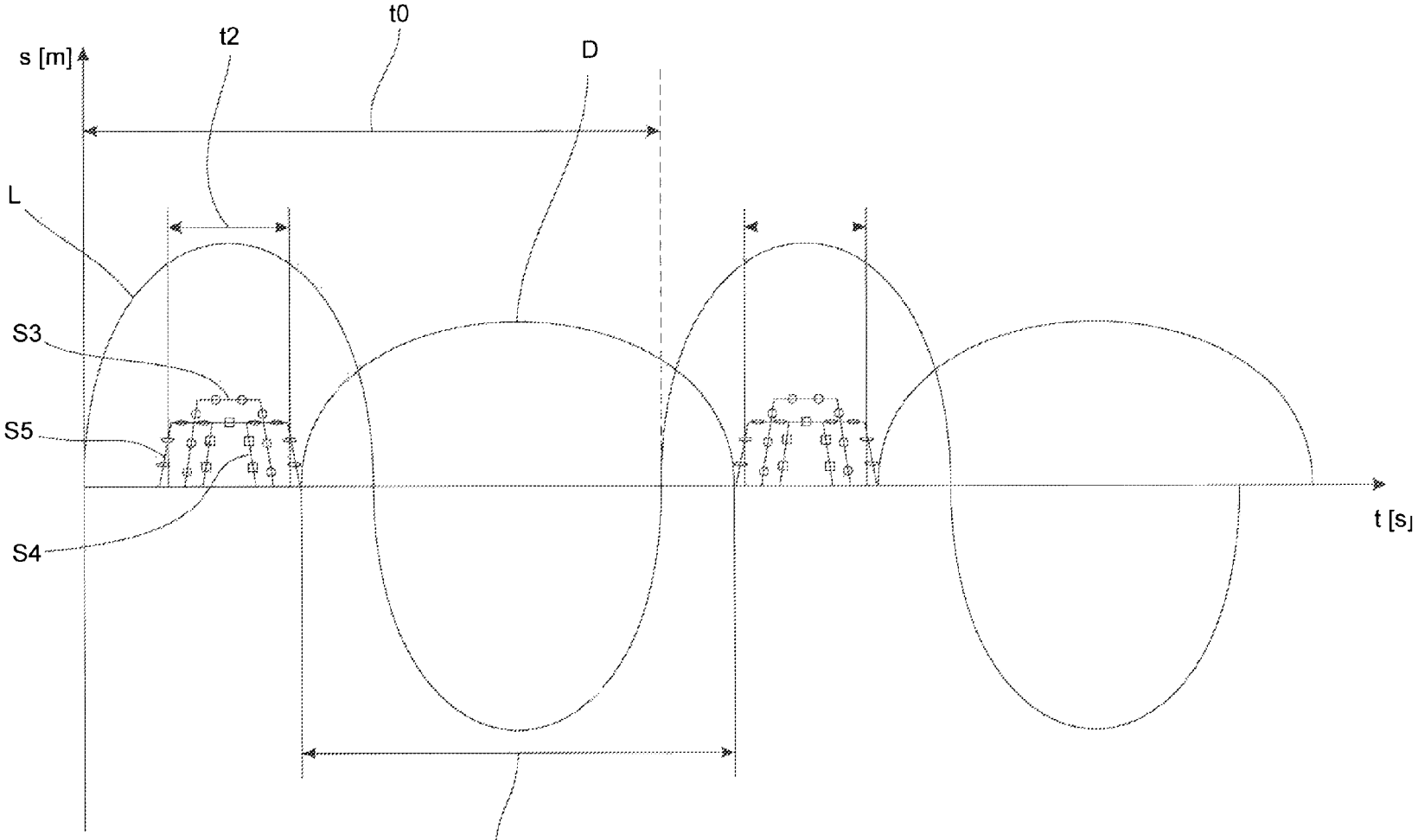

The schematic flow chart illustrated in FIG. 6 is an example of the processes taking place during the processing of the hollow bodies 7. The time t [s] is plotted on the abscissa of the flow chart and the path s [m] is plotted on the ordinate. The cyclical linear movement can, for example, be illustrated as a sine-shaped linear oscillation of the tool carrier 4 and is denoted with the letter L. The cyclical linear movement is repeated within a time interval denoted t0.

The rotary step movement, which is denoted with the letter D, can be illustrated by way of example as a sequence of sine curve halves, which are temporally spaced apart from one another. Each rotary step movement takes place within a time interval denoted t1. Preferably the cyclical linear movement and the rotary step movement are coordinated in such a way that the workpiece rotary table 3 rests while the processing tools 10 are engaged with the hollow bodies 7. The engaging period is denoted t2.

Although the linear actuations S3, S4 and S5 of the third, fourth and fifth actuating means 32, 33 and 34 are synchronised with one another, with regard to the forced coupling induced by the tension means with respect to the respective angular velocity, they have different phase courses due to the different geometrical design of the cam discs 35. The actuations S3 and S4 take place in the engaging period denoted t2, the actuation S5 already starts prior to the engaging period t2 and ends only after engaging period t2 has finished, where in the present case no overlap of the actuations S3, S4 and S5 with the rotary step movement are intended. As a result it is possible to ensure that the hollow bodies 7 are reliably fixed to the workpiece holders 6 during the rotary step movement.

The phase course S3 for the linear actuation of the third actuating means 32 is chosen in such a way that the clamping device 17 of the workpiece holder 6 arranged opposite is brought from the completely locked priority position into a completely unlocked unlocking position and subsequently back into the completely locked priority position again. The hollow body 7 can, for example, hereby be inserted into the workpiece holder 6 after a bottom forming process, in which contact of the bottom of the hollow body with an abutment area on the workpiece holder 6 is lost, and thus can be brought back into plane abutment on the workpiece holder 6.

The phase course S4 for the linear actuation of the fourth actuating means 33 is chosen in such a way that the clamping device 17 of the workpiece holder 6 arranged opposite is brought from the completely locked priority position into a partly unlocked unlocking position for a short period of time, which preferably corresponds to less than 15 percent of the cycle time of the cyclical linear movement, and subsequently back into the completely locked priority position again. As a result the hollow body 7 can, for example, be aligned correctly again with respect to the workpiece holder 6 following a processing operation with processing forces, which act on the hollow body 7 in an asymmetrical way.

The phase course S5 for the linear actuation of the fifth actuating means 34 is chosen in such a way that the clamping device 17 of the workpiece holder 6 arranged opposite is brought from the completely locked priority position into a partly unlocked unlocking position for a longer period of time, which nearly corresponds to 25 percent of the cycle time of the cyclical linear movement, and subsequently back into the completely locked priority position again. As a result the hollow body 7 can, for example, be turned into a correct rotatory position, following a detection operation, in which the rotatory position of the hollow body 7 about its longitudinal axis has been established, by means of a turning tool attached to the tool carrier 4.

The invention claimed is:

1. A forming device for cup-shaped hollow bodies having a machine frame, a drive device, a workpiece rotary table for accommodating workpiece holders which are formed to fix hollow bodies and having a tool holder for accommodating processing tools wherein the workpiece rotary table and the tool holder face one another and can be turned about a rotational axis in relation to one another and can be linearly moved in relation to one another along the rotational axis wherein the drive device is designed for providing a rotary step movement and a cyclical linear movement between the workpiece rotary table and the tool holder in order to enable the hollow bodies to be formed by means of the processing tools in a plurality of consecutive processing steps, and wherein the workpiece holder has a recess for accommodating a hollow body and a wall section which limits the recess in certain areas, has an adjustable geometry, which is designed to narrow the cross-section of the recess in order to enable the hollow body to be fixed on the workpiece holder wherein the wall section with the adjustable geometry is formed by a flexible membrane, which limits a fluid channel formed in the workpiece holder, in certain areas, wherein the flexible membrane comprises two substantially parallel legs and an interior surface area disposed between the two legs, the legs and the interior surface area defining a U-shaped cross-section, the U-shaped cross-section opening outwardly in the radial direction, in a cross-sectional plane, which comprises a longitudinal axis of the recess, and wherein the interior surface area of the flexible membrane delimits the recess of the workpiece holder in certain areas and moves upon pressurization of the fluid channel in both a radially inward direction and in an axial direction parallel to the longitudinal axis of the recess in the opposite direction of the mouth opening for pressing the hollow body into the workpiece holder.

2. A forming device according to claim 1, wherein a fluid displacement device is arranged in the fluid channel which fluid displacement device is designed for controlling a fluid pressure in the fluid channel so that it can effect a change of shape of the flexible membrane.

3. A forming device according to claim 2, wherein the fluid displacement device has a rigid working piston, which is mounted in a linearly movable manner, or a flexible working membrane which is clamped in a sealing manner on the edge-sides.

4. A forming device according to claim 2, wherein a preloading means is assigned to the fluid displacement device to place the displacement device into a priority position.

5. A forming device according to claim 4, wherein the fluid displacement device comprises an operating lever which is pivot-mounted and which is formed for coupling a working tappet which is functionally connected to the working piston or the working membrane, to the preloading means and/or for triggering an outer actuation onto the working tappet.

6. A forming device according to claim 1, wherein the flexible membrane is formed annularly.

7. A forming device according to claim 1, wherein the flexible membrane is adapted to move in both the radial direction and the axial direction simultaneously.

8. A forming device according to claim 1, wherein at least one leg of the U-shaped cross-section of the flexible membrane encloses an acute angle with the longitudinal axis of the recess.

9. A forming device according to claim 1, wherein at least one leg of the U-shaped cross-section of the flexible membrane has a circumferential bead in a radially exterior circumferential area, which bead is formed to be fixed in a sealing manner in the workpiece holder.

10. A forming device according to claim 1, wherein a cone ring is arranged between the flexible membrane and a mouth opening of the recess the conical interior surface of which cone ring limits the recess in certain areas and tapers as its distance from the mouth opening increases.

11. A forming device according to claim 1, wherein the flexible membrane is formed in an annular area for a touch contact with the hollow body which area has a width of less than 20 mm and which area is at a distance of less than 20 mm, from a bottom plane of the hollow body which bottom plane is determined by the recess.

12. A forming device according to claim 2, wherein the fluid displacement device is mounted in a linearly movable manner in the fluid channel.

13. A forming device according to claim 3, wherein the fluid displacement device has a flexible working membrane formed as a rolling membrane.

14. A forming device according to claim 4, wherein the preloading means comprises a spring means, the spring means placing the displacement device into a pressure position.

15. A forming device according to claim 8, wherein the at least one leg of the U-shaped cross-section of the flexible membrane encloses an angle less than 60 degrees.

16. A forming device according to claim 11, wherein the flexible membrane has a width less than 5 mm and is at a distance of less than 5 mm from the bottom plane of the hollow body.

* * * * *